US009528293B2

(12) United States Patent
Wolpert et al.

(10) Patent No.: US 9,528,293 B2
(45) Date of Patent: Dec. 27, 2016

(54) OPERATING ATTACHMENT FOR OPERATING A PUSH BUTTON AND/OR SWITCH

(71) Applicant: R. STAHL Schaltgerate GmbH, Waldenburg (DE)

(72) Inventors: Kai-Uwe Wolpert, Krautheim (DE); Ingo Wolff, Ohringen (DE)

(73) Assignee: R. Stahl Schaltgeräte GmbH, Waldenburg (DE)

( * ) Notice: Subject to any disclaimer, the term of this patent is extended or adjusted under 35 U.S.C. 154(b) by 148 days.

(21) Appl. No.: 14/283,368

(22) Filed: May 21, 2014

(65) Prior Publication Data

US 2014/0345339 A1 Nov. 27, 2014

(30) Foreign Application Priority Data

May 21, 2013 (DE) ..... 10 2013 105 165

(51) Int. Cl.
*H01H 1/52* (2006.01)
*H01H 3/20* (2006.01)
(Continued)

(52) U.S. Cl.
CPC ..... *E05B 15/00* (2013.01); *H01H 11/0018* (2013.01); *H01H 19/03* (2013.01);
(Continued)

(58) Field of Classification Search
CPC ..... H01H 19/04; H01H 21/01; H01H 1/00; H01H 1/06; H01H 3/00; H01H 3/02; H01H 3/08; H01H 3/54; H01H 13/00; H01H 13/14; H01H 13/22; H01H 13/26; H01H 13/50; H01H 2003/02; H01H 2003/12; H01H 2201/004; H01H 2205/00; H01H 2205/002; H01H 2205/004;H01H 2221/01; H01H 2223/01; H01H 2223/012; H01H 2223/028; H01H 2231/012; H01H 2231/016; H01H 9/00; H01H 19/02; H01H 2003/0293; H01H 2239/066; H01H 2221/00; H03K 17/962; H03K 17/975; H03K 2217/94073; H03K 2217/96066
(Continued)

(56) References Cited

U.S. PATENT DOCUMENTS 5,012,056 A * 4/1991 Abel ..... B60K 37/06 200/329
6,872,905 B2 * 3/2005 Kuepper et al. ..... 200/430

FOREIGN PATENT DOCUMENTS

DE 19962291 A1 * 6/2001 ..... H01H 11/0006

* cited by examiner

*Primary Examiner* — Renee Luebke
*Assistant Examiner* — Anthony R. Jimenez
(74) *Attorney, Agent, or Firm* — Leydig, Voit & Mayer, Ltd.

(57) ABSTRACT

An operating attachment (10) for operating a push button or switch, which includes a housing, (12) a handling part (11) having an actuator element (19) supported by said housing (12) for rotation in a direction of rotation (U), an operating element (26) displaceable parallel to a longitudinal axis (L) of the housing for operating a push button or switch, an operating drive (37) for transferring rotary movement of the actuator element (19) into a linear motion of the operating element (26) between an initial position (A) and an operating position (B), and a latching device (42) for latching the actuator element (19) in a latched position (R). The attachment apparatus (10) further includes at least one encoding element (48) moveable between a first encoding position (K1) that allows for rotation of the actuator (11) into the latched position (R) and a second encoding position (K2) which limits rotation of the actuator element (19) prior to
(Continued)

reaching the latched position (R). The illustrated encoding element (48) further is moveable to a third encoding position (K3).

13 Claims, 5 Drawing Sheets

(51) Int. Cl.

| | |
|---|---|
| ***H01H 9/00*** | (2006.01) |
| ***E05B 15/00*** | (2006.01) |
| ***H01H 11/00*** | (2006.01) |
| ***H01H 19/03*** | (2006.01) |
| ***H01H 19/635*** | (2006.01) |
| ***H01H 27/06*** | (2006.01) |

(52) U.S. Cl.
CPC ..... *H01H 19/6355* (2013.01); *H01H 27/06* (2013.01); *H01H 2011/0043* (2013.01); *Y10T 70/7486* (2015.04)

(58) Field of Classification Search
USPC ..... 200/318, 11 R, 5 E, 13, 14, 11 C, 19.07,200/19.08, 19.18, 296, 4, 336, 16 R, 3, 45, 520,200/565, 43.08, 43.03; 400/490, 491.2, 495.1
See application file for complete search history.

OPERATING ATTACHMENT FOR OPERATING A PUSH BUTTON AND/OR SWITCH

FIELD OF THE INVENTION

The invention relates to an operating attachment for operating a push button and/or switch. The operating attachment includes a handling part which is arranged in or at a housing so as to be rotatable in a circumferential direction about an axis of rotation. The rotation of the handling part is transferred via an operating drive into a linear motion of an operating element, which can move parallel to the axis of rotation and which can thereby operate an electric push button or switch. A rotary switch or a key and a corresponding lock can serve as handling part.

BACKGROUND OF THE INVENTION

An operating attachment, which is provided with a rotatable handling part, is known from DE 199 62 291 A1, for example. An operating attachment of modular design is described therein. Depending on the selection of the handling part and on the function, it is to be possible that the handling part must either be held (momentary-contact mode of operation) or, in the alternative, latches in response to a rotated or operated rotary control position. If the handling part latches in its rotary control position, the associated push button or switch is permanently operated via the operating element of the operating attachment. If the handling part does not latch in its rotary control position, it must be held manually there for as long as the associated electric push button or switch is to be operated.

The operating attachment according to DE 199 62 291 A1 includes encoding elements of varying designs. Depending on whether the handling part is to operate so as to latch or so as to have momentary contact, encoding elements of varying designs are inserted into the housing of the operating attachment on a rear side opposite to the handling part. The operation between the latched and the momentary mode can be changed accordingly by exchanging the encoding elements.

OBJECTS AND SUMMARY OF THE INVENTION

It is an object of the present invention to provide an improved attachment for operating a push button, electric switch, or the like. The operating attachment according to the invention includes a housing on which a handling part is arranged for relative rotation. The direction of rotation preferably corresponds to a circumferential direction around an axis of rotation and which can be formed by a longitudinal axis of the housing. An actuator element preferably arranged in the housing is coupled to the handling part in a torque-proof manner. In the case of an exemplary embodiment, the housing can be comprised of a plurality of individual housing parts.

At least one operating element is displaceably supported in or at the housing parallel to the axis of rotation. Preferably, one or two operating elements are provided. The number of the operating elements depends on the number of the possible rotary control positions of the handling part. Via an operating drive, the rotary motion of the handling part is transferred into a linear motion of the operating element between an initial position and an operating position.

The operating attachment also includes a latching means, which is preferably present at the operating element. The latching means acts on the actuator element when in a latched position. In the latched position, a positive and/or non-positive securing of the actuator element against an unintentional rotary motion in the direction of rotation is then effected. The handling part can thus be held in a corresponding rotary control position and the respective operating element can be held in the operating position. The latching means releasably secures the actuator element in its latched position so that it is possible to move from the latched position, for example, by means of a corresponding application of force on the handling part.

At least one encoding element also is present in or at the housing. The number of the encoding elements corresponds to the number of the operating elements that are present. Each encoding element is movably supported between a first encoding position and a second encoding position. In the first encoding position, the encoding element allows for a rotation of the actuator element into the latched position. For this purpose, the encoding element can be arranged in a longitudinal direction axially a distance away from the actuator element when in the first encoding position. In the second encoding position, the encoding element serves as stop for the actuator element. The rotation of the actuator in the direction of rotation is thus limited prior to reaching the latched position. The latching means cannot act on the actuator element or a part of the actuator element so as to protect it against an unintentional rotation in the latched position.

The first encoding position of the encoding element thus represents a latching operation and the second encoding position represents a momentary-contact operation of the operating attachment. For different rotary control positions of the handling part, the momentary-contact or the latching operation of the respective operating element can be provided in each case via the respectively assigned encoding element According to the invention, it is not necessary to provide different encoding elements and to exchange them. The mode of operation of the operating attachment can be switched between the latching and the momentary-contact mode of operation without exchanging encoding elements. It is sufficient to singly move the respective encoding element into the corresponding encoding position, for example to displace it and/or to rotate it. A disassembly of the operating attachment therefore is not necessary. When installing the operating attachment, it is not necessary to carry along replacement parts since the mode of operation of the operating attachment can be adjusted very easily by means of the position of the encoding element.

It is advantageous if the operating drive encompasses at least one operating projection, which is present at the actuator element, as well as at least one operating surface on the operating element, which runs at an incline in the direction of rotation. In response to a contact between the operating projection and the operating drive, a linear displacement of the operating element can be effected in the direction of rotation about the axis of rotation by means of a rotary motion of the operating projection. The operating drive thereby works like a wedge surface drive. In the case of a preferred exemplary embodiment, an operating projection is in each case present at the handling part for each operating element. An operating projection, which effects a linear motion of the operating element in response to a rotation of the actuator element, is thus provided for each operating element.

The latching means may be arranged adjacent to the operating surface at the operating element and can be formed by a latching recess in the case of an exemplary embodiment. In the latched position, the operating projection can engage with the latching recess.

Preferably, at least one pretensioning means is present. Each pretensioning means is associated with an operating element so that the number of the pretensioning means depends on the number of the operating elements. The pretensioning means applies a pretensioning force to the operating element that pulls or presses the associated operating element into its initial position. In the initial position, the free end of the operating element opposite the handling part is arranged at a smaller distance to the handling part than when in the operating positions.

In the case of a preferred exemplary embodiment, the encoding element can be switched between the first encoding position and the second encoding position by displacement parallel to the axis of rotation or the longitudinal axis of the housing. A corresponding guide recess for the encoding element can be present for this purpose in or at the housing. The axial displacement of the encoding element can be carried out very easily. In addition, it can be identified very quickly as a function of the axial position of the encoding element whether the latching or the momentary-contact function is assigned to a rotary control position of the handling part.

In particular, the encoding element includes a holding part. The encoding element can be held in a non-positive and/or positive manner at least in the first encoding position or at least in the second encoding position by means of the holding part. An accidental movement of the encoding element from one encoding position into the other encoding position is thus avoided.

The encoding element comprising the holding part preferably is made in one piece of a uniform material without seams and joints. The holding part is thus an integral part of the encoding element. In the case of a preferred embodiment, the holding part is embodied as a resiliently supported holding tongue. The holding tongue preferably extends approximately parallel to the axis of rotation or to the longitudinal axis of the housing. At least one holding projection, which cooperates with the housing for obtaining the holding effect, projects away from the holding tongue at right angles.

In the case of an exemplary embodiment, the encoding element can also have a third encoding position and can be moved between the second encoding position and the third encoding position by means of rotation. The rotation of the encoding element for switching between the second and the third encoding position takes place about an axis which runs parallel to the axis of rotation through the encoding element. This axis can correspond to the longitudinal axis of the encoding element.

Preferably, the encoding element has a first stop surface, and at a distance thereto, a second stop surface. A step can be present at the encoding element between the first stop surface and the second stop surface. In the second encoding position, the first stop surface of the encoding element is assigned in the direction of rotation to a counter stop surface at the actuator element so as to limit the rotary motion of the actuator element prior to reaching the latched position. It is furthermore advantageous if, in the third encoding position, the second stop surface of the encoding element is provided in the direction of rotation to the counter stop surface at the actuator element so as to limit the direction of rotation thereof only after reaching the latched position.

The third encoding position is advantageous, in particular, if a lock with a key is used as handling part. The third encoding position can be used to prevent the removal of the key when in the latched position.

Other objects and advantages of the invention will become apparent upon reading the following detailed description and upon reference to the drawings, in which:

BRIEF DESCRIPTION OF THE DRAWINGS

FIGS. 7A-9A are enlarged depictions of the operating drive in the different modes illustrated in FIGS. 7-9 respectively.

Figure 1:
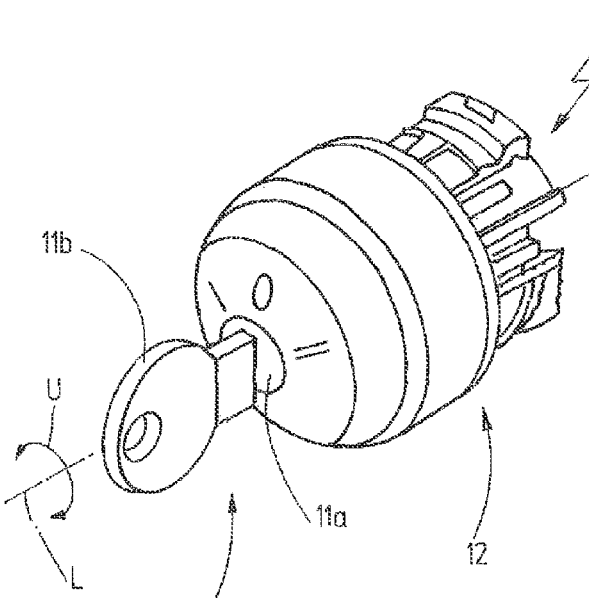
FIG. 1 is a perspective of an illustrated operating attachment in accordance with the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the invention is to cover all modifications, alternative constructions, and equivalents falling within the spirit and scope of the invention.

DETAILED DESCRIPTION OF THE PREFERRED EMBODIMENTS

Figure 1A:
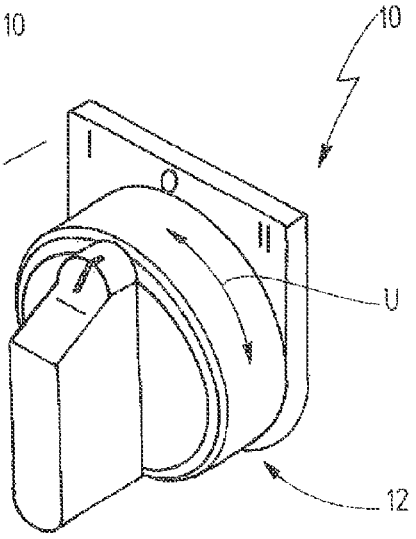
FIG. 1*a* is a perspective of an alternative embodiment of operating attachment according to the invention.

Referring now more particularly to FIG. 1 of the drawings, there is shown an illustrative operating attachment 10 in accordance with the invention. The operating attachment 10 includes a handling part 11, which can be rotated in a direction of rotation about a longitudinal axis L. The handling part in this case is in the form of a lock 11*a* and a key 11*b*. Alternatively, the angling part may take other forms, such as shown in FIG. 1A, in which the handling part 11 is in the form of a rotary control knob 11. In each of these illustrated embodiments, the operating attachment 10 has rotary control positions 0, I and II. It will be understood that provision could be made for more or fewer rotary control positions. While the following descriptions will be in relation to the embodiment in FIG. 1, it will be understood that they are equally applicable to alternative embodiments, including the embodiment of FIG. 1A.

The illustrated handing part 11 is arranged at or in a housing 12 of the operating attachment 10. The housing 12 in this case defines an approximately cylindrical inner area 13 arranged coaxially to the longitudinal axis L. In this case, the housing 12 has a multi-part design. It includes a cylindrical housing part 12*a* which is connected on its side to a ring-shaped housing part 12*b* associated with the handling part 11. The ring part 12*b* surrounds the handling part 11 and has a corresponding opening for the handling part. It will be appreciated that the housing 12 can encompass more or less than two housing parts 12*a*, 12*b*. The exact form and design of the housing 12 is adapted to the handling part 11.

The inner area 13 of the housing 12 is open on a rear side 14, which is located opposite the handling part 11. In the rear side 14 of the house 12 an electric push button and/or switch is provided, which can be operated via the operating attachment 10. A fastening means 15, for example, a thread or the like on an external side of the housing 12 provides a means by which the operating attachment 10 can be fastened at an attachment location, for example the wall or the door of a control box.

In the exemplary embodiment, the direction of rotation about the axis of rotation in which the handling part 11 can be moved between its rotary control positions 0, I, II, corresponds to a circumferential direction U about the longitudinal axis L of the inner area 13 or of the cylindrical part 12*a* of the housing 12. The direction of rotation will thus be identified herein below as a circumferential direction U. While in the illustrated embodiment, the axis of rotation is formed by the longitudinal axis L of the housing, alternatively the axis of rotation could run parallel to the longitudinal axis L.

Figure 3:
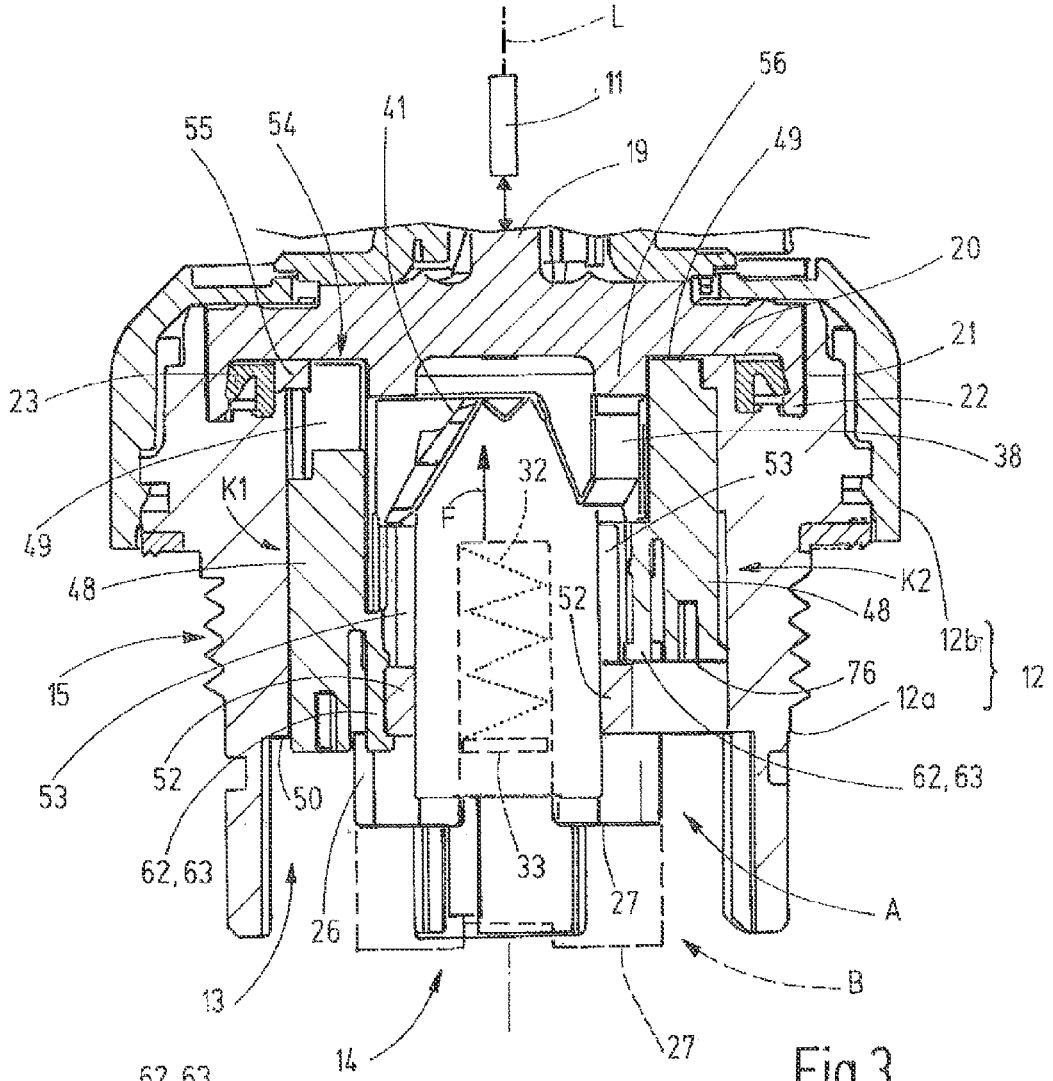
FIG. 3 is an enlarged fragmentary section of the operating attachment shown in FIG. 1.

The handling part 11 is coupled to an actuator element 19 in a torque-proof manner without relative rotation, which is illustrated schematically in FIG. 3 by means of the double arrow. The handling part 11 and the actuator element 19 can also be embodied integrally as a common component in one piece without a joint or seam. The actuator element 19 is rotatably arranged in or at the housing 12. In the case of the exemplary embodiment, the actuator element 19 includes a disk-shaped section 20, the edge of which is received in a receptacle or accommodation 21 of the housing 12. The actuator element 19 is slidingly supported at the housing 12 via the edge of the disk-shaped section 20. In this case, the accommodation 21 is formed between the two housing parts 12*a*, 12*b*. In the case of the exemplary embodiment, an axial flange 22, which extends coaxially to the longitudinal axis L of the housing 12, is provided at the edge of the disk-shaped section 20. A seal 23, which is arranged radially on the inside in the accommodation 24, is disposed within the axial flange 22.

Figure 4:
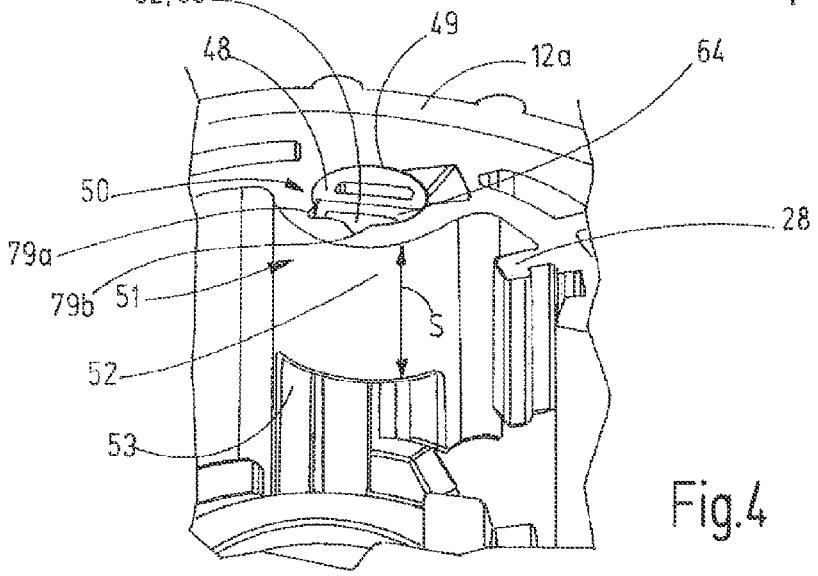
FIG. 4 is a fragmentary perspective of the encoding elements within the housing of the operating attachment is a third of its plurality of encoding positions.
Figure 5:
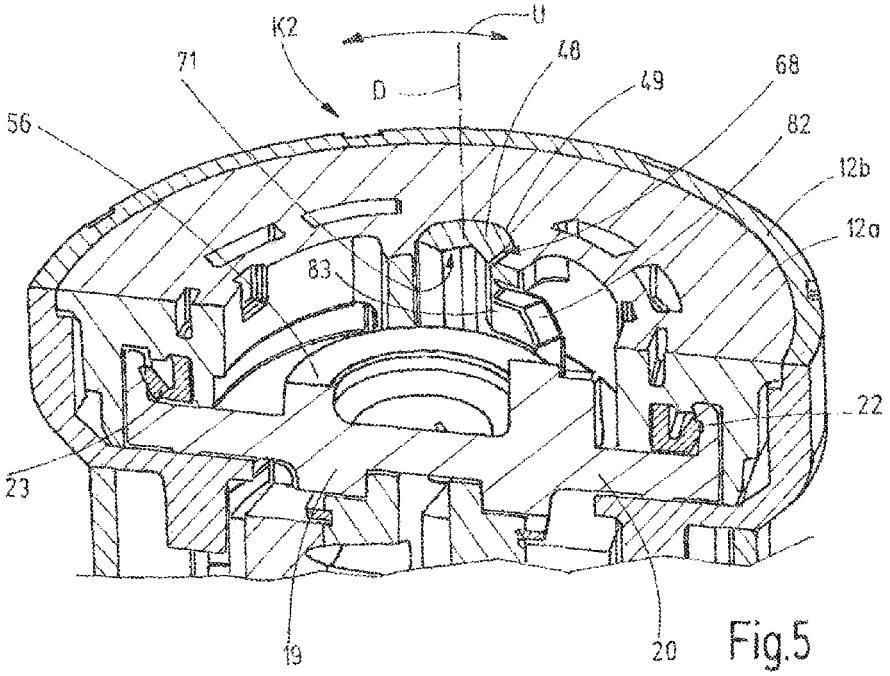
FIG. 5 is an enlarged fragmentary perspective of the illustrated operating attachment with the encoding element thereof in a second encoding position.
Figure 6:
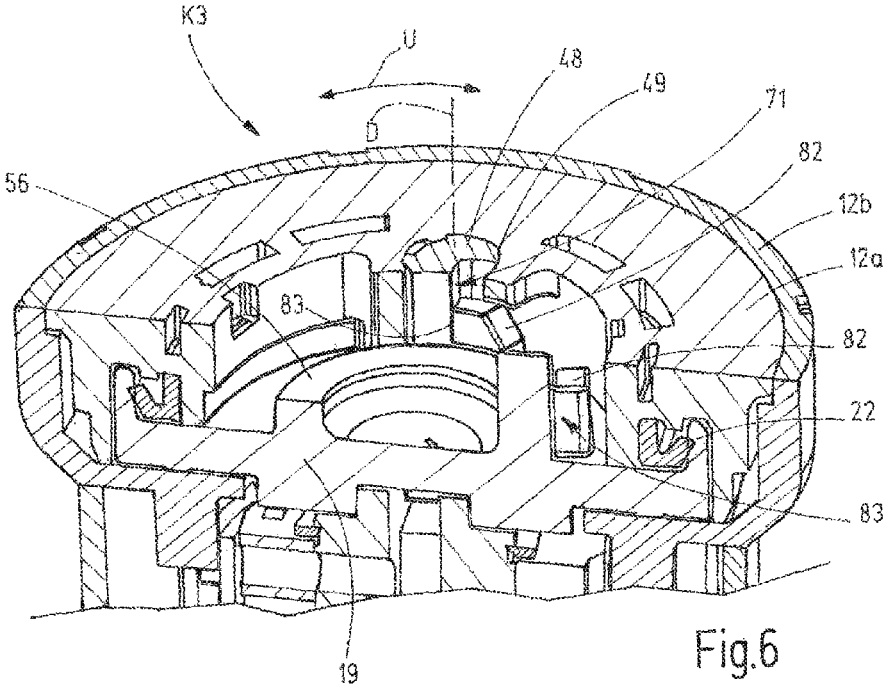
FIG. 6 is an enlarged fragmentary perspective, similar to FIG. 5, but showing the encoding element in a third encoding position.
Figure 10:
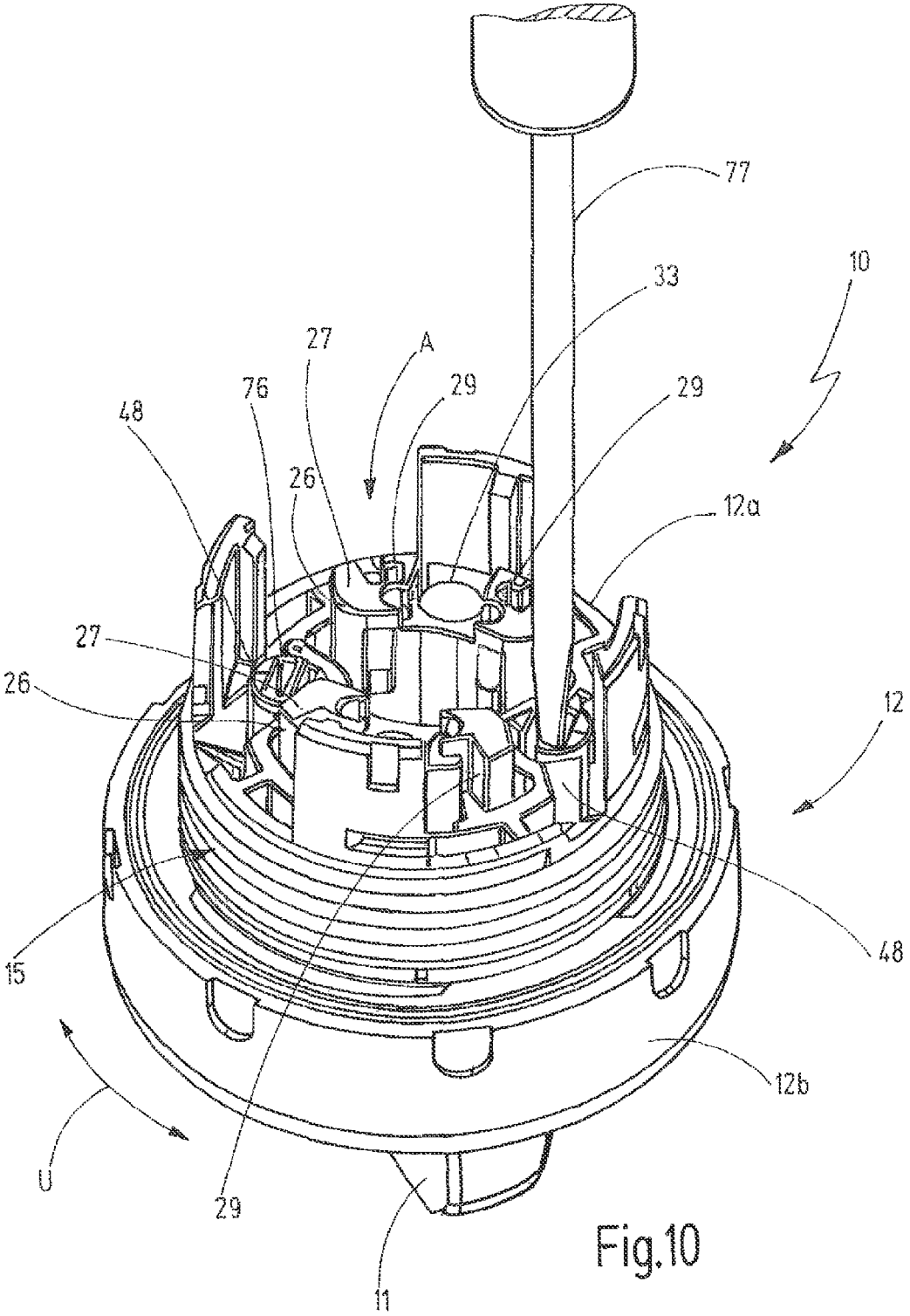
FIG. 10 is a further perspective of the illustrated operating attachment.

At least one operating element 26 is arranged in the inner area 13 of the housing 12 so as to be displaceable in axially parallel relation to the longitudinal axis L. In the case of the exemplary embodiment, the operating attachment 10 has three rotary control positions 0, I, II, so that two operating elements 26 are provided, which are located diametrically opposite one another relative to the longitudinal axis L (FIG. 10). Each operating element 26 has a free end 27 arranged at the open rear side 14 of the housing 12. A respectively assigned electric switch or push button is operated via the free end 27 of the operating element 26, if, originating in the initial position A, which is illustrated in FIGS. 3 and 10 by means of continuous lines, the operating element 26 is displaced into its operating position B, which is illustrated schematically in FIG. 3 by means of dashed lines. The operating elements 26 are in each case supported in the housing 12 via a guide means so as to be guided in a displaceable manner. One or a plurality of guide projections 28, which, according to the example, extend in longitudinal direction L at the inner wall of the cylindrical housing part 12*a*, about the inner area 13, in each case serve as guide means. In the case of the exemplary embodiment, the cross sections of the guide projections 28 have an L-shaped design (FIG. 4). Corresponding guide grooves 29 (FIG. 10), which also extend in longitudinal direction L are engaged by the guide projections 28 introduced into the operating elements 26.

A pretensioning force F, which is oriented substantially parallel to the longitudinal axis L, is applied by means of a pretensioning means 32, for example a spring or the like, to each operating element 26. The pretensioning means 32 is located in a recess of the operating element 26 and is supported at a flange 33 of the housing 12 (FIG. 10) on the one side and at the operating element 26 on the other side. The pretensioning means 32 in the form of a spring is illustrated schematically in FIG. 3.

Figure 7:
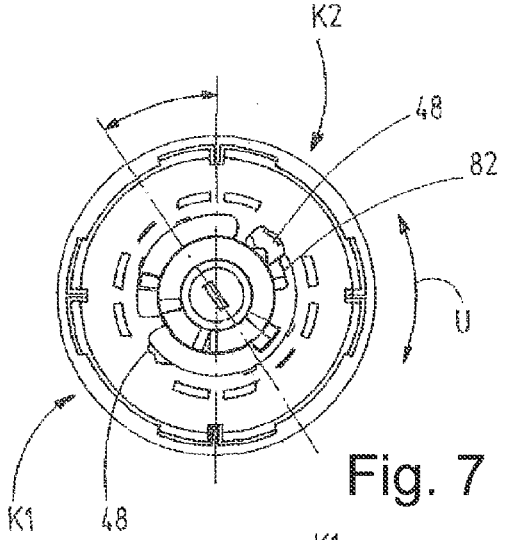
FIGS. 7-9 show different modes of operation of the operating attachment.
Figure 7A:
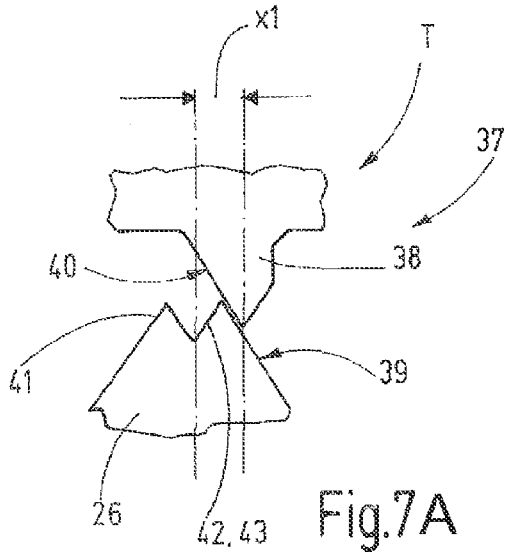
Figure 8:
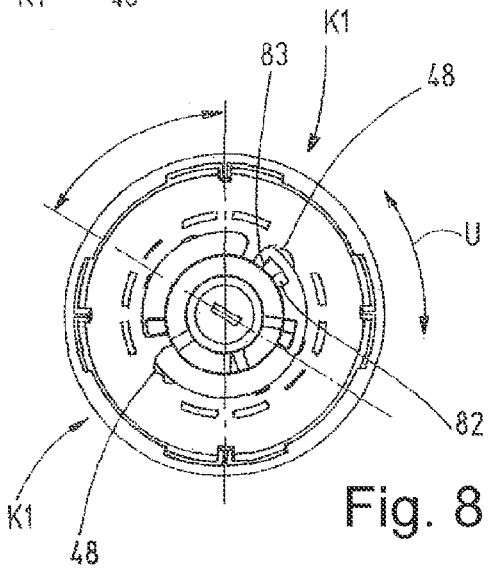
Figure 8A:
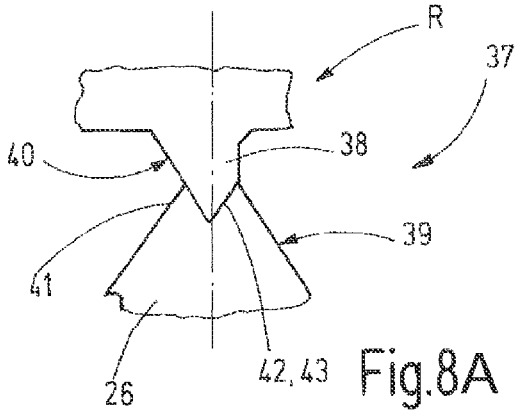
Figure 9:
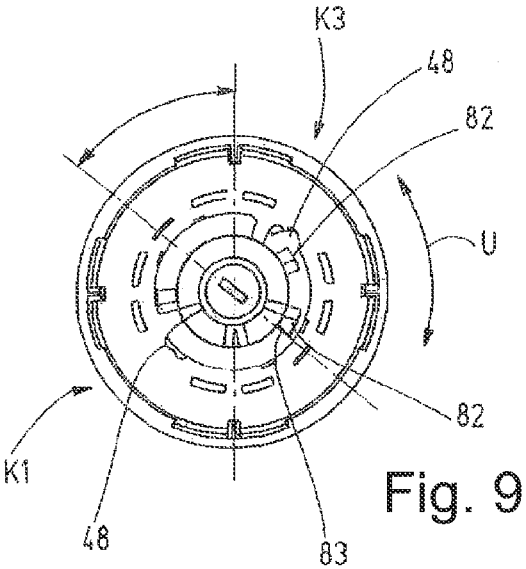
Figure 9A:
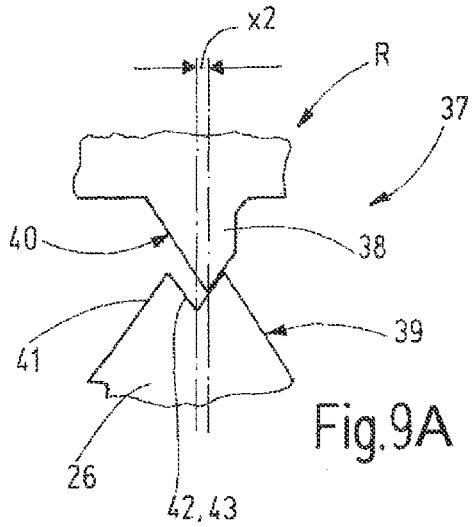

The rotary motion in the circumferential direction U of the handling part 11 is translated into a linear motion of the operating element 26 or the two operating elements 26 by means of an operating drive 37. According to the example, an operating projection 38 of the actuator element 19 is associated with the operating drive 37. The operating drive 37 is schematically illustrated in FIGS. 7 to 9. An operating surface 39, which runs at an incline in circumferential direction U, is associated with the operating projection 38. The number of the operating projections 38 corresponds to the number of the operating elements 26, with one operating projection being provided for each operating element 26. In the illustrated embodiment, a counter operating surface 40, which runs at an incline in circumferential direction and which is adapted to the incline of the operating surface 39, is present at the operating projection 38. In response to a corresponding rotation of the actuator element 19 in circumferential direction U, the operating projection 38 or the counter operating surface 40 thereof, respectively, can slide along the operating surface 39 of the operating element 26. The operating element 26 is displaced parallel to the longitudinal axis L in this manner. The operating drive 37 is thus effected via the operating projection 38 and the operating surface 39. It operates like a wedge surface drive. Provision could also be made for other operating drives or types of guide mechanisms.

At the inner end 41 of the operating element 26, which is located opposite to the free end 27, each operating element 26 has a latching means 42, which is arranged adjacent to the operating surface 39. In this case, the latching means 42 is formed by means of a latching recess 43. In the case of the exemplary embodiment, the latching recess 43 has an approximately triangular cross sectional shape and is adapted to the tip of the operating projection 38 which cooperates with the operating element 26. In a latched position, the operating projection 38 engages with the latching groove 43. The latched position R is illustrated in FIGS. 8 and 9.

The operating attachment 10 further includes an encoding element 48 for each operating element 26 which cooperates with the actuator element 19. It serves the purpose of assigning a momentary-contact operation or a latching operation to an assigned rotary control position I and/or II. In the latched operation, the handling part 11 remains in its respective rotary control position I and/or II and the assigned operating element 26 remains in its operating position B. To attain this, the operating projection 38 of the actuator element 19 is held in the latched position R (FIG. 8) by means of the latching means 42 of the respective operating element 26. In the momentary-contact operation, the encoding element 48 limits the rotary motion of the actuator part 19 such that the operating projection 38 does not reach the latching means 42, according to the example, the latching groove 43, but such that its rotary motion along the operating surface 39 is limited in that the encoding element 38 acts at the actuator part 19. The momentary-contact position T of the operating projection 38, when the assigned operating element 26 is in its operating position B, is illustrated schematically in FIG. 7.

In the case of the exemplary embodiment, two encoding elements 48 are present in accordance with the number of the operating elements 26. The encoding elements 48 have a cylindrical-like contour and can thus also be identified as encoding pins. The encoding elements 48 are illustrated in detail in FIG. 2. All of the encoding elements 48 in this case are identical. Each encoding element 48 consists of a uniform material and is produced in one piece without a seam and joint.

The encoding elements are arranged to the inner area 13 of the housing 12. A guide channel 49, into which the encoding element 48 can be inserted parallel to the longitudinal axis L from the rear side 14 of the housing 12, is provided for each encoding element 48 at the cylindrical housing part 12*a*. The guide channel 49 can be open in sections towards the inner area 13. At its end 50 on the rear side, which is assigned to the rear side 14, the guide channel 49 includes a first section 51, which in this case is closed in a ring-shaped manner. The wall section 52 of the guide channel 49, which is closed in the first section 51 towards the inner area 13, encompasses an opening 53 to the inner area 13 in axial direction following the first section 51. On the side opposite to the first section 51, the inner end 54 of the guide channel 49 is limited axially by means of the actuator element 19 and, according to the example, by means of the disk-shaped section 20, viewed in the direction of the longitudinal axis L. At the inner end 54, the cylindrical housing part 12*a* includes a ledge 55. Further radially inwards, the actuator element 19 has a ring projection 56 at a distance to this ledge 55. At two locations, which are spaced apart in circumferential direction U, the two operating projections 38 project away from this ring projection 56. The inner end 54 of the guide channel 49 is thus limited radially on the outside by the ledge 55 and radially on the inside by the ring projection 56.

Figure 2:
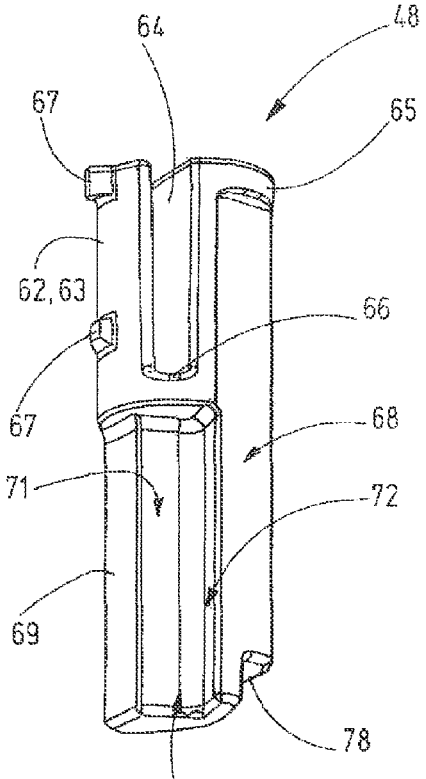
FIGS. 2 and 2*a* are side perspectives of an encoding element of the illustrated operating attachments.
Figure 2A:
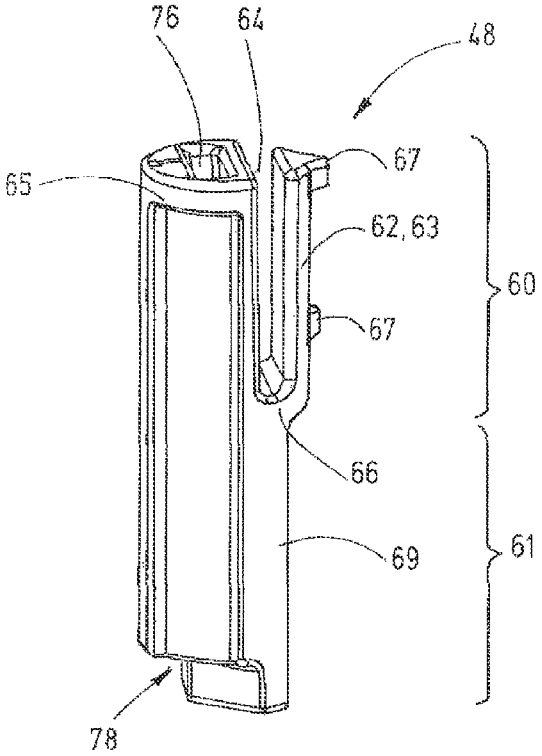

The encoding element 48 illustrated in detail in FIGS. 2 and 2A includes a first axial section 60 and a directly adjoining second axial section 61. In the first axial section 60, the encoding element 48 has a holding part 62, which serves the purpose of holding the encoding element 48 in a first encoding position K1. The first encoding position K1 for an encoding element 48 is illustrated in FIG. 3 by means of the left encoding element 48. In the first encoding position K1, the holding part 62 cooperates with the wall section 52 so as to hold the encoding element 48 in the first encoding position K1 in a non-positive and/or positive manner. The holding part 62 protects the encoding element 48 against an inadvertent axial displacement parallel to the longitudinal axis L in the guide channel 49.

In the illustrated embodiment, the holding part 62 is formed by means of a holding tongue 63, which runs approximately in longitudinal direction L and which is supported in a resilient manner. The holding tongue 63 is spaced apart from an approximately half-cylindrical part 65 of the encoding element 48 via a gap 64. The holding tongue 63 is connected to the half-cylindrical part 65 via a web 66 only on one side so that the free end of the holding tongue 63, which is located opposite the web 66, can be pivoted in a resilient manner about a pivot axis, which is formed in the area of the web 66.

At least one holding projection 67 is present at the holding tongue 63. In the case of the exemplary embodiment, a first holding projection 67 is arranged at the free end of the holding tongue 63 and a further holding projection 67 is arranged axially at a distance thereto. The distance between the two holding projections 67 corresponds to the axial dimension s of the wall section 52 in the first section 51 of the guide channel 49.

The half-cylindrical part 65 extends through the entire first axial section 60 parallel to the holding tongue 63 and further into the second axial section 61. An area of the outer surface of the half-cylindrical part 65 is flattened and forms a first stop surface 68 in the second axial section 61. In the second axial section 61, the encoding element 48 encompasses an appendage 69, approximately adjoining the flexible tongue 63 and the gap 64 adjacent to the half-cylindrical part 65. A step recess 70, at which a second stop surface 71 is formed, is present at the appendage 69. Adjoining the second stop surface 71, the stop recess has a connecting surface 72, which is oriented approximately at right angles to the second stop surface 71, and which forms a connection between the first stop surface 68 and the second stop surface 71.

The two stop surfaces 68, 71 are arranged in two different planes, which encompass a different distance to an axis D, about which the encoding element 48 can be rotated in the guide channel 49. The axis D is the longitudinal axis of a cylinder, at the jacket surface of which the outermost parts of the encoding element 48 are arranged, when the latter is arranged in the guide channel 49.

At its end, which is located in the first axial section 60, the encoding element 48 encompasses a slit 76, which serves as contact means for a tool 77 (FIG. 10). At the end of the encoding element 48, which is located in the second axial section 61, a recess 78, with which the ledge 55 engages when the encoding element 48 is in a second encoding position K2 (right encoding element 48 in FIG. 3), is provided at the half-cylindrical part 68.

In this second encoding position, the encoding element 48 in the case of the exemplary embodiment is secured against an axial displacement, in that the holding tongue 63 or the holding projection 67 which is present at the free end of the holding tongue 63, engages with the opening 53 below the first section of the guide channel 49.

A first groove 79*a* as well as a second groove 79*b* as depicted in FIG. 4 are provided at the guide channel 49 and, according to the example, in the wall section 52. The two groves 79*a*, 79*b* are open towards the guide channel 49. The grooves 79*a*, 79*b* in each case provide a rotational position of the encoding element 48 about the axis D. In each rotational position, the holding part 62 engages with an assigned groove 79*a*, 79*b* and protects against an inadvertent rotation about the axis D in a non-positive and/or positive manner. The rotational positions provided by the grooves 79*a*, 79*b* correspond to the rotational positions of the encoding element 48 in the encoding positions K1, K2, K3.

A stop part 82 having a counter stop surface 83 is present at the actuator element 19 in circumferential direction U about the longitudinal axis L at a distance to the operating projection 38 (FIGS. 5-9). The counter stop surface 83 is located in circumferential direction on the side of the stop part 82, which faces the encoding element 48. In the case of the exemplary embodiment, two stop parts 82 are present, which are arranged at a distance to one another in circumferential direction U. In this case, the respective counter stop surfaces 83 face away from one another, because, starting at its neutral rotary control position 0, the operating attachment can be rotated in circumferential direction U in opposition directions of rotation. The respective counter stop surfaces 83 thereby in each case face the respective assigned encoding element 48. As depicted in FIGS. 6-9, the stop parts 82 are arranged further radially outwardly than the operating projections 38.

The mode of operation of the operating attachment 10 will be described below with reference to the illustrated embodiment.

When the encoding elements 48 are in their first encoding position K1, they are arranged in the respective guide channel 49 at an axial distance to the actuator element 19 and the movement area of the stop parts 82. The encoding elements 48 thus cannot come into contact with assigned stop parts 82. The actuator element 19 is not limited in its rotary motion by the encoding elements 48 in circumferential direction U. In response to the rotation of the actuator element 19 in circumferential direction U clockwise or counter-clockwise, one of the two operating projections 38 comes into contact with the assigned operating element 26 so that it slides along the respective operating surface 39. The actuator element 19, which is supported at the housing 12, thereby presses the operating element 26 against the pretensioning force F so that the operating element 26 moves linearly parallel to the longitudinal axis L and thereby moves away from the handling part 11. The mode of operation is the same, regardless of whether the handling part 11 is rotated clockwise or counter-clockwise together with the actuator element 19, starting in the neutral control position 0. A different operating element 26 is in each case moved linearly through the corresponding operating projection 38 and is displaced from its initial position A into the operating position B. In the operating position B, the respective operating element 26 can operate an electric switch or push button.

When the encoding elements 48 are in the first contact location K1, the operating projection 38 can engage with the latching groove 43 and is protected at that location against an unintentional movement in circumferential direction U (FIG. 8). The pretensioning force F of the pretensioning element 32 acts axially in the direction of the longitudinal axis L and can thus not carry out the movement of the operating element 26 back into its initial position A.

By axial displacement parallel to the longitudinal axis L in the guide channel 49, an encoding element 48 can be moved into its second encoding position K2 (FIGS. 3 and 7). In this position, the encoding element 48 projects with its second axial section 61 into the movement area of the stop part 82 so that the rotary motion of the actuator element 19 is limited in circumferential direction U. In the second encoding position K2, the first stop surface 68 of the encoding element 48 faces the counter stop surface 83 of the stop part 82. As is illustrated schematically in FIG. 7, the rotary motion of the operating projection 38, which deflects the operating element 26, is limited in a momentary-contact position T prior to reaching the latching groove 43. The free end of the operating projection 38 thereby has a first distance x1 to the center of the latching groove 43. The operating projection 38, or the counter operating surface 40 thereof, rests against the operating surface 39 in the momentary-contact position T. This momentary contact position T is only maintained, if an operator exerts a torque at the actuator element 19 via the handling part 11. If this torque is not exerted, the pretensioning means 32 presses the operating element 26 from the operating position B back into the initial position and the operating projection 38 thereby slides along the operating surface 39. The momentary-contact position T cannot be maintained without a torque from an operator.

The encoding elements 48 can optionally also be moved into a third encoding position K3. The switching between the second encoding position K2 and the third encoding position K3 can be seen, for example, in FIGS. 5, 6 and 10. With the help of the tool 77, the encoding element 48 can be rotated about the axis of rotation in the guide channel 49 so that the second stop surface 71 of the encoding element 48 faces the stop part 82 or the counter stop surface 83, respectively. As is illustrated schematically in FIG. 9, the encoding element 48 in the third encoding position K3 also limits the rotary motion of the actuator element 19. However, the operating projection 38 can reach the latching groove 43 and thus the latched position R, but not in the same manner as in the first encoding position K1 such that it reaches the center of the latching groove 43 (FIG. 8), but a second distance x2 remains between the free end of the operating projection 38 and the middle of the latching groove 42, as is illustrated schematically in FIG. 9. In the third encoding position K3, the handling part 11 can thus also be held so as to latch in the corresponding rotary control position so that the respective operating element 26 remains in its operating position B. When using a handling part 11 in the form of a lock 11*a* and a key 11*b*, the removal of the key 11*b* can be prevented by means of the third encoding position K3, because the lock 11*a* has not been brought completely into the rotary position in which a removal of the key is possible.

According to the invention, it is thus made possible to switch an encoding element 48 by means of axial movement—and in the case of the exemplary embodiment additionally by rotating the encoding element 48 about an axis D—between at least two encoding positions K1, K2 and, according to the example, between three encoding positions K1, K2, K3. Either a momentary-contact or a latched mode of operation is assigned to each encoding position K1, K2, K3, when the handling part 11 is rotated into the corresponding rotary control position I or II. An exchanging of parts or components is not necessary. A latched mode of operation (first encoding position K1 or third encoding position K3) or a momentary-contact mode of operation (second encoding position K2) can in each case be assigned to each rotary control position I, II of the handling part via an encoding element. In the latched mode of operation, the removal of the key 11*b* can also be optionally made possible when using a key-lock combination as handling part 11 (first encoding position K1) or can be prevented (third encoding position K3).

A cylindrical space remains in the inner area 13 around the longitudinal axis L so that, in the case of a modified embodiment, the handling part 11 can also be illuminated via an illuminating means, for example so as to display the operation of the assigned electric switch or push button, respectively.

From the foregoing, it can be seen that the invention relates to an operating attachment 10 for operating a switch and/or push button. The operating attachment encompasses a handling part 11, which can be rotated in circumferential direction U about a longitudinal axis L of a housing 12. The handling part 11 can thus be rotated clockwise and/or counter-clockwise into different rotary control positions. An operating element 26 is supported at the housing 12 so as to be capable of being displaced in the direction of the longitudinal axis L. An actuator element 19 is coupled to the handling part 11 in a torque-proof manner. The rotary motion of the actuator element 19 is translated into a linear motion of the operating element 26 via an operating drive 37. By means of the linear displacement of the operating element 26, an electric switch and/or push button can be operated. An encoding element 48, which cooperates with the actuator element 19, is assigned to the operating element 26. The encoding element 48 can be moved in the housing 12 between two or three different encoding positions K1, K2, K3 by means of displacement and/or rotation. In a first encoding position K1, the rotary motion of the actuator element 19 is permitted in an unhindered manner by means of the encoding element 48, wherein the actuator element 19 can be moved into a latched position R. In a second encoding position K2, the encoding element 48 limits the rotary motion of the actuator element 19 prior to reaching the latched position R in a momentary-contact position T.

LIST OF REFERENCE NUMERALS

10 operating attachment
11 handling part
11*a* lock
11*b* key
11*c* rotary control knob
12 housing
12*a* cylindrical housing part
12*b* housing part
13 inner area
14 rear side
15 fastening means
19 actuator element
20 disk-shaped section
21 accommodation
22 axial flange
23 seal
26 operating element
27 free end of the operating element
28 guide projection
20 guide groove
32 pretensioning means
33 flange
37 operating drive
38 operating projection
39 operating surface
40 counter operating surface
41 inner end of the operating element
42 latching means
43 latching recess
48 encoding element
49 guide channel
50 end of the guide channel on the rear side
51 first section of the guide channel
52 wall section
53 opening
54 inner end of the guide channel
55 ring ledge
56 ring projection
60 first axial section
61 second axial section
62 holding part
63 holding tongue
64 gap
65 half-cylindrical part
66 web
67 holding projection
68 first stop surface
69 appendage
70 step recess
71 second stop surface
72 connecting surface
76 slit
77 tool
78 recess
79*a* first groove
79*b* second groove
82 stop part
83 counter stop surface
A initial position
B operating position
D axis
F pretensioning force
K1 first encoding position
K2 second encoding position
K3 third encoding position
L longitudinal axis of the housing
R latched position
s axial dimension
T momentary-contact position
U circumferential direction
x1 first distance
x2 second distance

The invention claimed is:

1. An operating attachment (10) for operating a push button or switch comprising:

a housing (12), a handling part (11) having an actuator element (19) and being supported by said housing (12) for rotation in a direction of rotation (U), at least one operating element (26) supported in relation to the housing (12) for displaceable movement parallel to a longitudinal axis (L), an operating drive (37) for transferring movement of the actuator element (19) in the direction of rotation (U) into a linear motion of the operating element (26) between an initial position (A) and an operating position (B), a latching device (42) for latching the actuator element (19) in a latched position (R), and at least one encoding element (48) contained within the housing (12) for movement between a first encoding position (K1), a second encoding position (K2) and a third encoding position (K3) wherein in the first encoding position (K1) the encoding element (48) allows for a rotation of the actuator element (19) into the latched position (R), while in the second encoding position (K2) the encoding element (48) stops the actuator element (19) and limits the rotation thereof in the direction of rotation (U) prior to reaching the latched position (R), while in the third encoding position (K3) the encoding element (48) stops the actuator element (19) and limits the rotation of the actuator element (19) after reaching the latched position (R).

2. The operating attachment according to claim 1 in which the operating drive (37) includes at least one operating projection (38) associated with the actuator element (19) and at least one operating surface (39) associated with the operating element (26) disposed at an incline in the direction of rotation (U) that cooperates with a respective operating projection (38) of the actuator element (19).

3. The operating attachment according to claim 2 in which said latching device (42) is arranged adjacent to the operating surface (39) associated with the operating element (26).

4. The operating attachment according to claim 3 in which the latching device (42) includes a latching recess (43).

5. The operating attachment according to claim 1 including at least one pretensioning element (32) for applying a pretensioning force (F) to the operating element (26) and pushing the operating element (26) into the initial position (A).

6. The operating attachment according to claim 1 in which the encoding element (48) is switchable between the first encoding position (K1) and the second encoding position (K2) by displacement in a direction parallel to the longitudinal axis (L).

7. The operating attachment according to claim 1 in which the encoding element (48) includes a holding part (62) for holding the encoding element (48) in one of both of the first encoding position (K1) or the second encoding position (K2).

8. The operating attachment according to claim 1 in which the encoding element (48) includes a holding part (62) for holding the encoding element (48) in either one of the first encoding position (K1) and the second encoding position (K2).

9. The operating attachment according to claim 7 which the holding part (62) is an integral part of the encoding element (48).

10. The operating attachment according to claim 7 in which the holding part (62) includes a resiliently supported holding tongue (63) having at least one holding projection (6) projecting away from the holding tongue (63) at a right angle.

11. The operating attachment according to claim 1 in which the encoding element (48) can be moved between the second encoding position (K2) and the third encoding position (K3) by rotating the encoding element (48) about an axis of rotation (D) parallel to the longitudinal axis (L).

12. The operating attachment according to claim 11 in which said encoding element (48) includes a first stop surface (68) and a second stop surface (71).

13. The operating attachment according to claim 12 wherein when the encoding element (48) is in the second encoding position (K2), the first stop surface (68) of the encoding element (48) cooperates with a counter stop surface (83) of the actuator element (19) when moved in the direction of rotation (U) so as to limit the rotary motion of the actuator element (19) prior to reaching the latched position (R).

* * * * *